US005320223A

United States Patent [19]

Allen

[11] Patent Number: 5,320,223

[45] Date of Patent: Jun. 14, 1994

[54] INSERT HAVING PART NUMBERS OR THE LIKE PRINTED AT THE BOTTOM OF RETAINING RECESSES

[75] Inventor: Philip L. Allen, Palatine, Ill.

[73] Assignee: Foam Cutting Engineers, Inc., Addison, Ill.

[21] Appl. No.: 34,462

[22] Filed: Mar. 19, 1993

[51] Int. Cl.[5] ..... B65D 85/20

[52] U.S. Cl. ..... 206/372; 206/523; 206/564; 206/459.5; 220/507; 220/453

[58] Field of Search ..... 220/453, 513, 507; 206/562, 563, 564, 557, 523, 587, 591, 592, 593, 594, 372, 373, 376, 459.5

[56] References Cited

U.S. PATENT DOCUMENTS 4,076,116 2/1978 Sowders ..... 206/564 X
4,327,136 4/1982 Thompson et al. ..... 206/557 X
4,702,377 10/1987 Grone ..... 206/557
4,736,843 4/1988 Leonard ..... 206/372 X
4,779,729 10/1988 Aoyama ..... 206/459.5 X
4,964,514 10/1990 Wycech ..... 206/587 X

*Primary Examiner*—Paul T. Sewell
*Assistant Examiner*—Jacob K. Ackun, Jr.
*Attorney, Agent, or Firm*—Robert L. Marsh

[57] ABSTRACT

An insert for a tool box drawer or the like has a first lower layer of compressible material such as foam above which is a second upper layer of compressible material. The second upper layer of compressible material has a plurality of cut outs therein, each cut out being in the shape of the silhouette of the item or tool to be retained therein. A film of material is bonded between the first layer of compressible material and the second layer of compressible material such that the cut out portions become pockets. Labels are provided at the bottom of each pocket by printing information on either the first layer of compressible material or on the film with the printing positioned so as to be visible through the cut out portions of the upper second layer of compressible material. Where the lower layer of compressible material is non-porous, the film is not required.

4 Claims, 2 Drawing Sheets

INSERT HAVING PART NUMBERS OR THE LIKE PRINTED AT THE BOTTOM OF RETAINING RECESSES

The present invention relates to inserts for tool drawers or the like having a plurality of pockets for retaining tools and in particular to an insert made of elastomeric foam and having a label at the bottom of each pocket which includes a part number to identify the tool to be retained therein.

BACKGROUND OF THE INVENTION

Tool boxes are commonly available which have a plurality of drawers, and within each drawer is an insert having a plurality of depressions or pockets therein each of which is shaped to retain a specific tool. Where such tool boxes are intended for use by auto mechanics, TV repairmen or other industries in which there are a great number of technicians, the tool boxes can be manufactured in volume and the inserts made of molded plastic or the like. Furthermore, the identification of the tool which is to be fitted into each pocket can be printed into the bottom of the molded inserts during the manufacturing process such that a user may easily return a tool to its correct location, or determine what tool, if any, is misplaced.

In certain industries, technicians are required who use tools which are not commonly available. For example, the military, space related projects, and medical related industries require specialized service technicians who make use of tools, many of which are highly specialized. The government, for example, has at any one time a number of specialized projects in process, and the technicians for each of the projects make use of a different set of specialized tools. Such users require that a tool box be custom assembled for the use of each technician. Since some of the tools are specially manufactured to suit the task of the technician, the tools themselves are often very expensive and, therefore, it is desirable to have an effective method of tracking tools on a work site. In some cases, such as space and military related projects, it is necessary for technicians to undertake a tool audit after the completion of each service task to avoid leaving a tool within the serviced equipment. Tool control is also important to minimize the time expended and cost incurred by the highly paid technicians.

To undertake a positive tool control, corporations desire a tool management system which provides for the quick identification of tools such that they may be easily inventoried and replaced. Technicians must be provided with a tool box which has inserts with pockets suitable for retaining the required tools. It is also desirable that the inserts bear labels which bear identifying part numbers or the like. In the preferred embodiment, one label would be imprinted at the bottom of each of the pockets.

Custom made tool boxes are usually made in quantities of from one to ten. Also, when a customer reorders a custom tool box, the customer will frequently require that the box be redesigned to accommodate changes in the tools to be stored therein. Such low volume short order tool boxes cannot be assembled with inserts of molded plastic. Presently, the inserts for custom made tool boxes are made of a closed cell compressible foam. These inserts have a lower layer of foam which rests on the bottom of the tool box drawer and an upper layer of foam having cut outs therein. Each of the cut outs in the upper layer is in the shape of the silhouette of the tool to be retained therein. The upper layer of foam is bonded to the lower layer and the upper surface of the lower layer becomes the bottom of the pocket, and edges of the cut outs in the upper layer become the sides of the pockets.

Purchasers of custom tool boxes are concerned with positive tool control and tool management systems and desire inserts for tool drawers which have labels at the bottom of each pocket similar to that which is available for large volume boxes. The United States Government has, for example, included labels at the bottom of the pockets in its specifications for custom tool boxes, however, the Government has withdrawn these specifications because custom made inserts as described above will not retain printed information on the foam of which they are made. Efforts to imprint a part number or the like on such inserts by etching the information into the foam or printing the information on the surface of the foam using a silk screen, ink jet or laser printing method have all been unsuccessful. It has been found that the pigment of the coloring used in such printing flakes off the foam of the insert, and the information printed thereon is rapidly lost.

It would, therefore, be desirable to provide a tool box insert which is made of compressible foam material having a plurality of pockets, and further having a label permanently printed at the bottom of each pocket thereof for identifying the tool to be retained therein.

SUMMARY OF THE INVENTION

Briefly, the present invention is an insert for a container, such as a drawer or the like, for retaining a plurality of uniquely shaped items such as tools. The insert has a first lower layer of compressible material such as foam above which is a second upper layer of compressible material which has a plurality of cut outs therein, each cut out being in the shape of the silhouette of the item or tool to be retained therein. A film of material suitable for retaining printed material thereon is bonded between the first layer of compressible material and the second layer of compressible material with the printed material on the film positioned so as to be visible through the cut outs in the upper layer of compressible material.

In a second embodiment of the present invention, the first lower layer of compressible material has information printed thereon at locations which would be visible through the cut out portions of the upper second layer of compressible material. A film of transparent material is bonded to the first layer of compressible material to thereby protect the printing on the surface thereof, and the second upper layer of compressible material is bonded to the film. In this embodiment, the information is printed on the first layer of compressible material and is retained by the transparent film positioned between the first and second layers of compressible material.

In a third embodiment of an insert according to the present invention, the first lower layer of compressible material is a non-porous material such that information may be printed thereon. In this embodiment, the first layer of compressible material would have printed matter thereon at locations which would be visible through the cut out portions of the second layer of compressible material when the second layer of compressible material is positioned over and bonded to the first layer of compressible material.

An insert in accordance with the first and second embodiments of the present invention can be made by providing a first layer of compressible material; providing a second layer of compressible material having a plurality of cut outs therein; and providing a film having an upper and lower surface. Information is printed on one of the film and the first layer of compressible material, and the lower surface of the film is bonded to the upper surface of the first layer of compressible material, and the lower surface of the second layer of compressible material is bonded to the upper surface of the film.

The present invention further includes the steps of bonding the film to a layer of compressible material using a hot melt adhesive which has been found to be suitable for bonding such materials together.

BRIEF DESCRIPTION OF THE DRAWINGS

A better understanding of the present invention will be had by a reading of the detailed description of a preferred embodiment taken in conjunction with the drawings wherein.

DETAILED DESCRIPTION OF A PREFERRED EMBODIMENT

Figure 3:
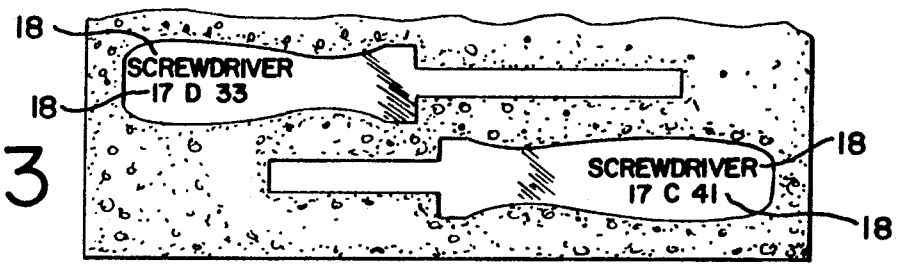
FIG. 3 is a fragmentary top view of the insert in FIG. 2 showing a pocket therein with information imprinted at the bottom thereof in accordance with the present invention.
Figure 1:
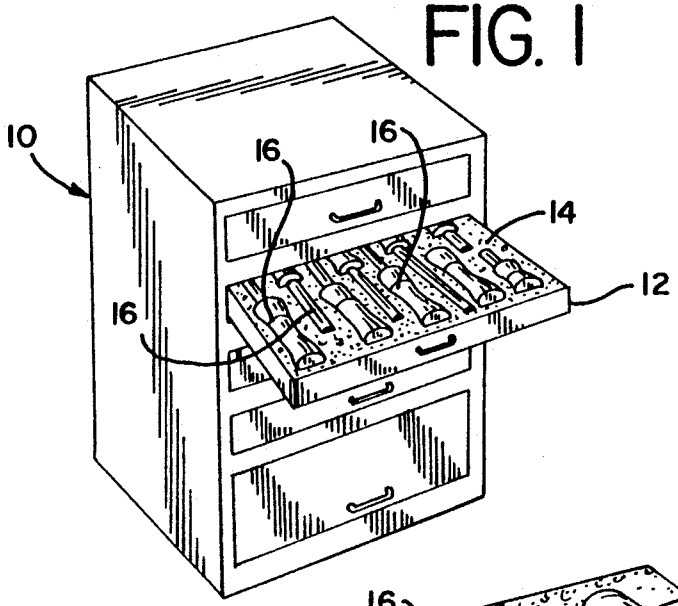
FIG. 1 is a isometric view of a tool box having a drawer, and an insert in the drawer in accordance with the present invention.
Figure 2:
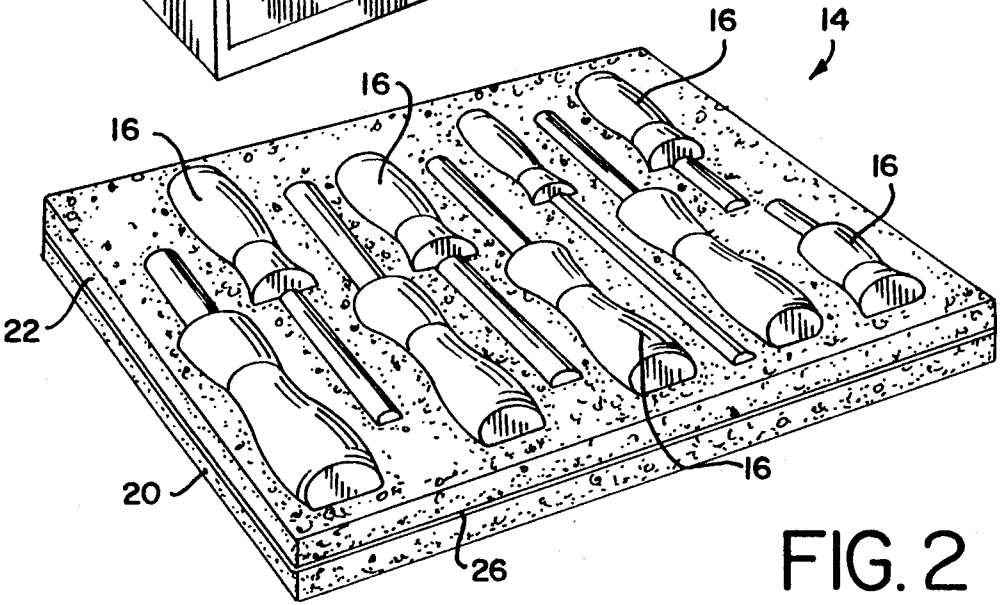
FIG. 2 is an isometric view of an insert in accordance with the present invention which is suitable for fitting within one of the drawers of the tool box in FIG. 1.

Referring to FIGS. 1, 2 and 3, a tool box 10 has a rectangular slidable drawer 12 into which is fitted an insert 14 in accordance with the present invention. The insert 14 is rectangular in shape with outer dimensions suited to enable the insert 14 to fit slidably within the drawer 12. The upper surface of the insert 14 has a plurality of pockets 16, which are in the form of depressions in the upper surface thereof. The peripheral edges of each pocket 16 is in the shape of the silhouette of a tool which is to be retained in the respective pocket. At the bottom of each pocket 16 is a label 18 which may include a part number or other information to identify the tool to be fitted therein.

Figure 4:
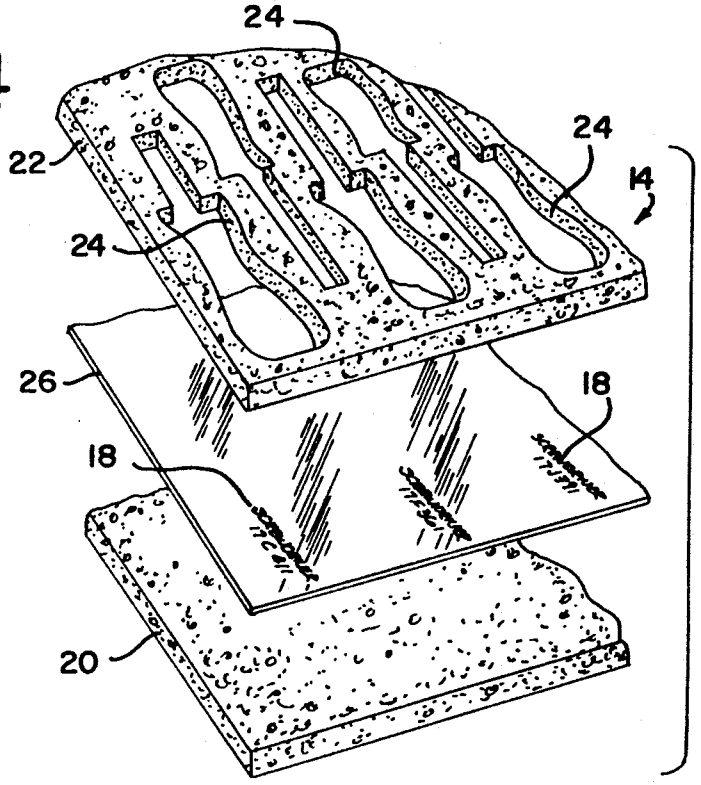
FIG. 4 is an exploded fragmentary perspective view of the insert of FIG. 2.

Referring to FIGS. 2 and 4, an insert 14 in accordance with the present invention has a lower layer 20 of compressible material such as a closed cell elastomeric foam such as a polyethylene foam. The lower layer 20 is rectangular in shape with outer dimensions suitable to fit within the drawer 12 of the tool box 10 and having a thickness which is typically between ⅛ and one inch. The upper portion of the insert 14 is a second layer 22 of a compressible material such as the elastomeric foam used for to the first layer 20, which is also rectangularly shaped to fit within the drawer 12 of the tool box 10 and typically having a thickness between ¼ inch and 1 inch. The upper layer 22 has a plurality of cut out portions 24 each of which is in the shape of the silhouette of the tool to be retained therein.

In accordance with the present invention, there is further provided a film 26 suitable for receiving printed information. The film 26 also has rectangularly shaped outer edges and is positioned above the upper surface of the first lower layer 20 and below the bottom surface of the second upper layer 22. The film 26 is preferably made of a plastic material such as mylar acetate or the like. Imprinted on the surface of the film 26 ar a plurality of labels 18 bearing information to identify the items to be retained. The labels 18 are positioned upon the film 26 at locations such that when the lower surface of the film 26 is bonded to the first layer 20 and the upper surface of the film 26 is bonded to the second layer 22, the cut out portions 24 form the side walls of the pockets 16 and the upper surface of the film 26, forms the bottom of the pockets 16. The labels 18 then will be visible through the cut out portions 24 in the second layer 22 as shown in FIG. 3.

The film 26 may be made of any suitable material which can receive printed information and can be bonded between the first layer 20 and second layer 22, however, a polyethylene terephthalate has been found to be a suitable material for the film 26 one such product is sold by Du Ponte under the trademark MYLAR. Furthermore, any suitable adhesive which will secure the surfaces of the film 26 to the first and second layers 20, 22 may be used to bond the portions together to form an insert 14. Where the film 26 is made of mylar, a hot melt adhesive has been found to be suitable for the purposes of joining the first and second layers 20, 22 to the film 26. Such an adhesive is not environmentally harmful as are solvent based adhesives such as trichlorolate, which has been widely used for bonding together the layers of prior art inserts and is an acknowledged carcinogen.

Figure 5:
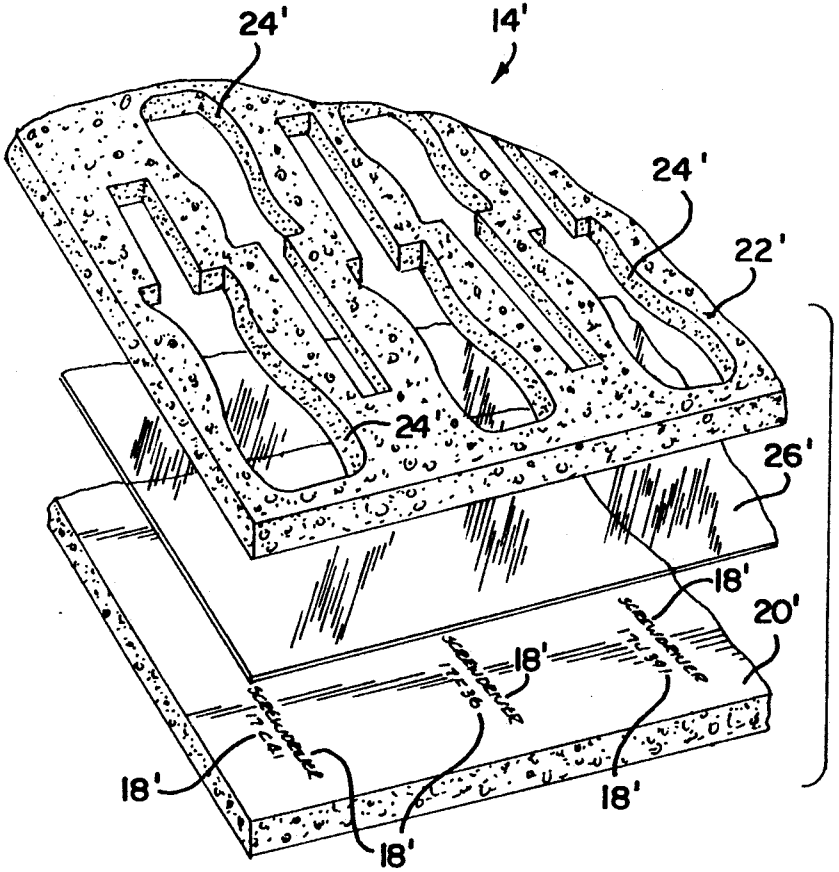
FIG. 5 is an exploded fragmentary perspective view of a second embodiment of an insert for insertion in a drawer shown in FIG. 1.

A second embodiment of the present invention is depicted in FIG. 5 in which items therein which are like items as described with regard to the first embodiment bear like indicia numbers except that they are primed.

In this embodiment, the film 26' which is positioned above the upper surface of the lower layer 20' is transparent and the labels 18' are printed on the upper surface of the first layer 20'. As was described with regard to the first embodiment, the labels 18' are positioned on the first layer 20' at locations such that when the insert 14' is assembled, the labels 18' will be visible through the cut out portions 24' in the second layer 22'. When the insert 14' is assembled, and the film 26' is bonded to each of the first and second layers 20', 22', the label 18' can be seen through the transparent film 26' and through the cut out portions 24' of the second layer 22'. In this embodiment, the film 26' protects the print of the label 18' and prevents the pigment bearing material thereof from flaking off.

Figure 6:
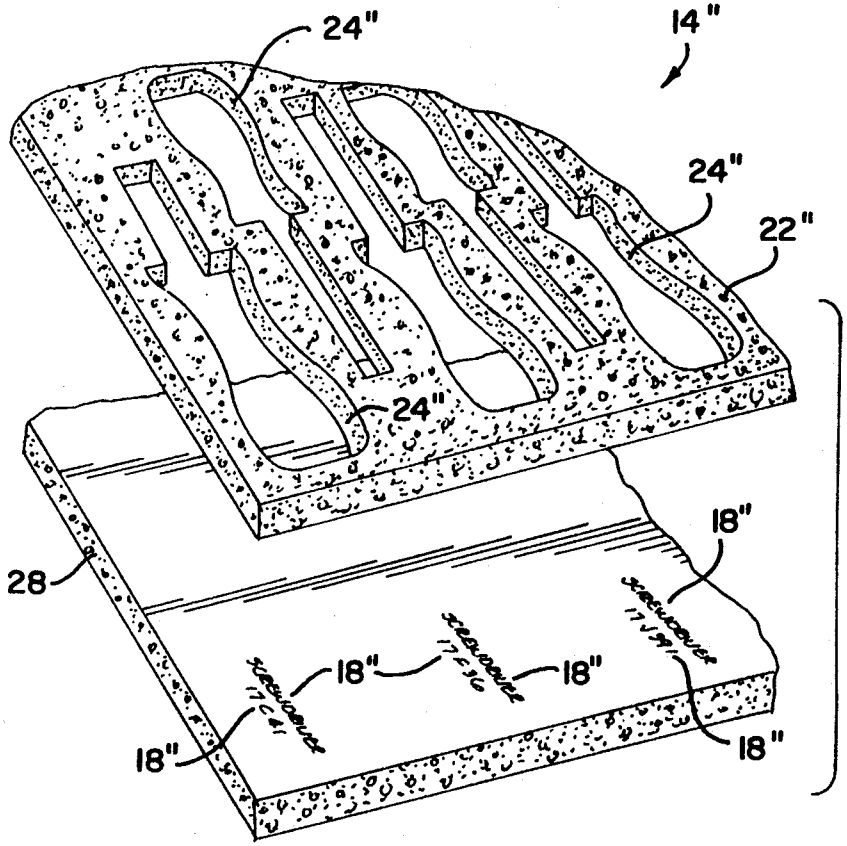
FIG. 6 is a exploded fragmentary isometric view of a third embodiment of an insert for insertion in a drawer shown in FIG. 1.

A third embodiment of the present invention is shown in FIG. 6 in which items thereof which are like items of the first embodiment bear like indicia numbers except that they are double primed. In this embodiment, an insert 14" has a lower layer 28 made of a non-porous elastomeric material such as rubber, or an equivalent elastomeric synthetic material, which will receive printed material on the surfaces thereof. The lower layer 28 is rectangular in shape and sized to fit within a slidable drawer 12 and has a suitable thickness to provide a lower pad for the insert 14". A thickness of between ⅛ inch and ⅜ inch may be sufficient for a lower layer 28.

Labels 18" are printed upon the upper surface of the lower layer 28 and are positioned thereon such that when the upper layer 22" is bonded to the lower layer 28, the labels 18" will be visible through the cut out portions 24" as is the case in the first and second embodiments described above.

There has been above described a method of manufacturing an insert for a drawer of a tool box for retaining tools therein which has a plurality of pockets in the shape of the silhouette of a tool to be retained and having a label at the bottom of each of the pockets thereof to identify the tool associated therewith. The inserts as described above can be custom made and will provide for tool control as desired by users of custom tool boxes.

While the present invention has been described in connection with three embodiments, it will be understood by those skilled in the art that many changes and modifications may be made without departing from the true spirit and scope of the invention. It is, therefore, intended by the appended claims to cover all such changes and modifications which come within the true spirit and scope of the invention.

What is claimed is:

1. An insert for a container, for retaining a plurality of items, comprising in combination:

first layer of non-porous elastomeric material receptive to printing having an upper surface and a lower surface and having a plurality of labels printed thereon, a second layer of porous compressible material having an upper surface and a lower surface and having a plurality of cut out portions extending rom said upper surface to said lower surface, and being in the shape of the silhouette of an item to be retained therein, said labels printed upon said upper surface of said first layer and aligned within said cut out portions of said second layer, said upper surface of said first layer and said lower surface of said "second" layer bonded together, and each of said labels visible through one of said cut outs and containing information descriptive of said item for which said one of said cut outs has the shape of the silhouette thereof.

2. An insert for a container, for retaining a plurality of items, comprising in combination:

a first layer of compressible material having an upper surface, a second layer of compressible material having an upper surface and a lower surface and a plurality of cut outs therein extending from said upper surface to said lower surface, a flexible film having a lower surface bonded to said upper surface of said first layer and an upper surface bonded to said lower surface of said second layer, each of said cut outs in the shape of the silhouette of an item to be retained therein, a plurality of labels printed on said flexible film aligned within said cut outs in said second layer and visible on the side of said film bonded to said lower surface of said second layer, and each of said labels visible through one of said cut outs and containing information descriptive of an item for which said one of said cut outs has the shape of the silhouette thereof.

3. An insert in accordance with claim 2 wherein said film is made of a polyethylene terephthalate.

4. An insert for a container, for retaining a plurality of items, comprising in combination:

a first layer of compressible material having an upper surface, a second layer of compressible material having an upper surface and a lower surface and a plurality of cut outs therein extending from said upper surface to said lower surface, a transparent flexible film having a lower surface bonded to said upper surface of said first layer and an upper surface bonded to said lower surface of said second layer, each of said cut outs in the shape of the silhouette of an item to be retained therein, a plurality of labels printed on said upper surface of said first layer aligned with said cut outs in said second layer and visible through said cut outs, and each of said labels being visible through one of said cut outs and containing information descriptive of an item for which said one of said cut outs has the shape of the silhouette thereof.

* * * * *

UNITED STATES PATENT AND TRADEMARK OFFICE

CERTIFICATE OF CORRECTION

PATENT NO. : 5,320,223

DATED : June 14, 1994

INVENTOR(S) : Philip L. Allen

It is certified that error appears in the above—identified patent and that said Letters Patent is hereby corrected as shown below:

In column 5, at line 36, after "extending" delete "rom" and substitute -- from --.

Signed and Sealed this

Thirtieth Day of August, 1994

*Attest:*

*Attesting Officer*

BRUCE LEHMAN

*Commissioner of Patents and Trademarks*